US007310858B2

(12) United States Patent
Fleissner

(10) Patent No.: US 7,310,858 B2
(45) Date of Patent: Dec. 25, 2007

(54) METHOD AND TRANSPARENT PATTERNING OF A MATERIAL WEB AND DEVICE FOR CARRYING OUT SAID METHOD

(75) Inventor: Gerold Fleissner, Zug (CH)

(73) Assignee: Fleissner GmbH, Egelsbach (DE)

( * ) Notice: Subject to any disclaimer, the term of this patent is extended or adjusted under 35 U.S.C. 154(b) by 523 days.

(21) Appl. No.: 10/483,335

(22) PCT Filed: Jun. 25, 2002

(86) PCT No.: PCT/EP02/06987

§ 371 (c)(1),
(2), (4) Date: Jul. 22, 2004

(87) PCT Pub. No.: WO03/008691

PCT Pub. Date: Jan. 30, 2003

(65) Prior Publication Data

US 2005/0015950 A1 Jan. 27, 2005

(30) Foreign Application Priority Data

Jul. 10, 2001 (DE) ..... 101 32 563

(51) Int. Cl.
*D06C 23/00* (2006.01)

(52) U.S. Cl. ..... 28/104; 28/167

(58) Field of Classification Search ..... 28/104, 28/105, 106, 167, 163; 34/108, 110, 111, 34/115, 122, 130, 595, 444, 452, 453
See application file for complete search history.

(56) References Cited

U.S. PATENT DOCUMENTS

| | | | | | |
|---|---|---|---|---|---|
| 3,056,406 | A * | 10/1962 | Ness | 28/104 |
| 3,679,535 | A * | 7/1972 | Kalwaites | 28/105 |
| 3,750,237 | A * | 8/1973 | Kalwaites | 28/105 |
| 3,769,659 | A * | 11/1973 | Kalwaites | 28/104 |
| 3,889,325 | A * | 6/1975 | Fleissner | 26/18.5 |
| 4,592,943 | A * | 6/1986 | Cancian et al. | 428/171 |
| 5,274,893 | A * | 1/1994 | Kitamura et al. | 28/105 |
| 5,674,587 | A * | 10/1997 | James et al. | 28/104 |
| 6,055,710 | A * | 5/2000 | Fleissner | 28/104 |
| 6,338,187 | B1 * | 1/2002 | Fleissner | 28/106 |
| 6,865,784 | B2 * | 3/2005 | Noelle | 28/104 |
| 2002/0100153 | A1 * | 8/2002 | Takai et al. | 28/104 |
| 2003/0019088 | A1 * | 1/2003 | Carter | 28/104 |

* cited by examiner

*Primary Examiner*—A. Vanatta
(74) *Attorney, Agent, or Firm*—Antonelli, Terry, Stout & Kraus, LLP.

(57) ABSTRACT

The invention relates to a method for generating three-dimensional transparent patterns on a non-woven fabric or similar, whereby, for example, hot air is sucked through openings which form the pattern in the circumferential surface of a drum. The openings are straight or curved gaps instead of conventional holes and together with other openings form the desired pattern. The air or similar, flowing through the gaps, presses the fibres into the gaps and the vacuum on the inner side of the drum sucks said fibres onto the patterning.

25 Claims, 2 Drawing Sheets

Figure 1:
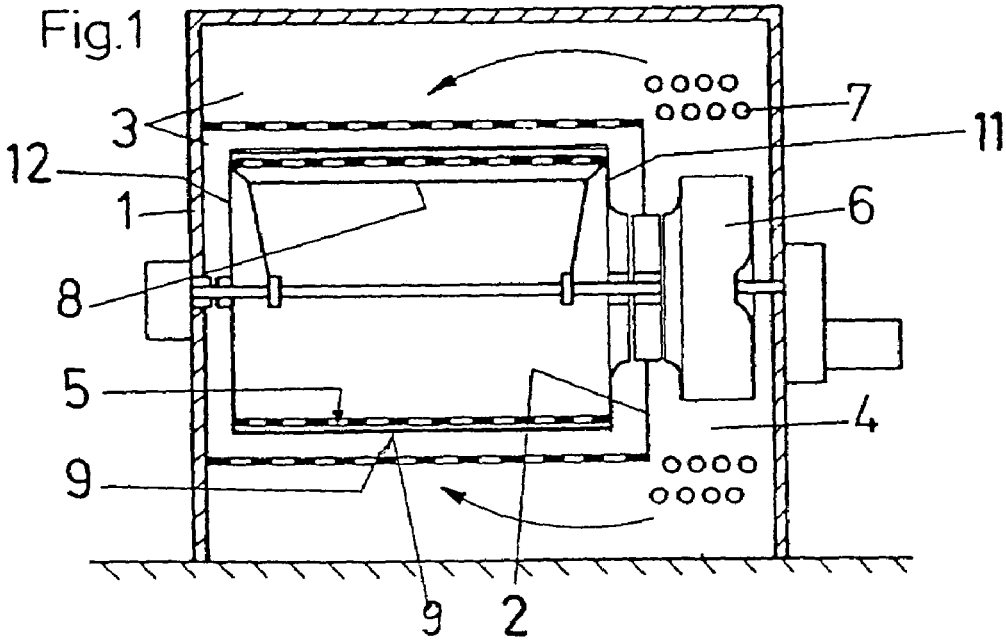

METHOD AND TRANSPARENT PATTERNING OF A MATERIAL WEB AND DEVICE FOR CARRYING OUT SAID METHOD

The invention relates to a method for colorless patterning of a fabric web made of mutually interlocked and thus strengthened fibers of natural or synthetic type, preferably of a nonwoven fabric such as nonwoven wadding fabric, which is also dried in the case of a wet treatment such as hydrodynamic needling or an upgrading process, the fabric web being pressed by an overpressure and under pressure acting on a fluid against a conveying element having perforations, the cross-sectional areas of the perforations generating the pictorial pattern on the fabric web.

A method of this type is known from EP-A-0 105 730. There, hot air is guided against an endless pattern-imparting belt made of bars or wires and lying on a drum, on which belt the fabric web rests. Similar matter is disclosed in DE-A-199 29 105, in which water is pressed against a nonwoven fabric that rests on a pattern-imparting textured screen. In both cases, the pattern on the fabric web is generated by the texture pattern of the endless belt.

From U.S. Pat. No. 5,115,544 or also DE-A-199 12 279 or DE-A-199 12 905 it is known to provide a screen with a profile-imparting elevation against which the nonwoven fabric to be patterned is pressed by water jets. Depending on what figures are applied as elevations on the endless screen, extremely varied patterns can be generated, possibly also as patterns of perforations. Similar matter is disclosed in EP-A-0 511 025, according to which elevations on a screen once again provide the colorless pattern. Here, too, hot air can be employed as the medium for moving the fibers.

A more expensive method for colorless patterning with air is disclosed in U.S. Pat. No. 4,499,637. There, high-energy air jets are blown from computer-controlled nozzles against the fabric web. Further, it is known from DE-A-21 09 143 to move over the fabric web a template with cutouts corresponding to the desired pattern, hot air under pressure being blown against the template. This method known from the method of color printing has not, however, given satisfaction either. The same applies to the idea according to DE-A-20 21 188, in which patterning with the template is likewise effected with hot air, the air causing individual fibers of the pile-like fabric web to shrink as desired for the pattern.

Beginning with the method of the type stated at the outset, it is a goal of the invention to find a method with which any pattern can be continuously imposed on the nonwoven fabric or the like without great expense and indeed without the need to consider a texture pattern of an endless conveying belt.

In order to achieve the goal, the invention provides that the fluid is led away in full-surface fashion in the region of the perforations of the conveying element and also in the region of its smooth surface supporting the fabric web. Thus it is not the texture of a conveying element that generates the pictorial pattern but rather the cross-sectional area of perforations present on the conveying element. To this end, however, the smooth surface that forms the perforations and supports the fabric web is also permeable to the fluid.

In the case of a wet treatment, for example if the fabric web has been strengthened by hydrodynamic needling, the fabric web must be dried in any event. If, now, the heat-treatment apparatus such as a perforated-drum dryer is provided with a peripheral surface that is provided with perforations generating an image, then the desired pattern can arise by itself without additional expense.

The fibers are partly sucked through the perforations of the pattern by the under pressure, so that a three-dimensional colorless pattern made of the fibers themselves is produced on the nonwoven fabric. The method according to the invention can, however, also be performed without a drying operation, both with cold and with warm or hot air, steam or a fluid.

Figure 2:
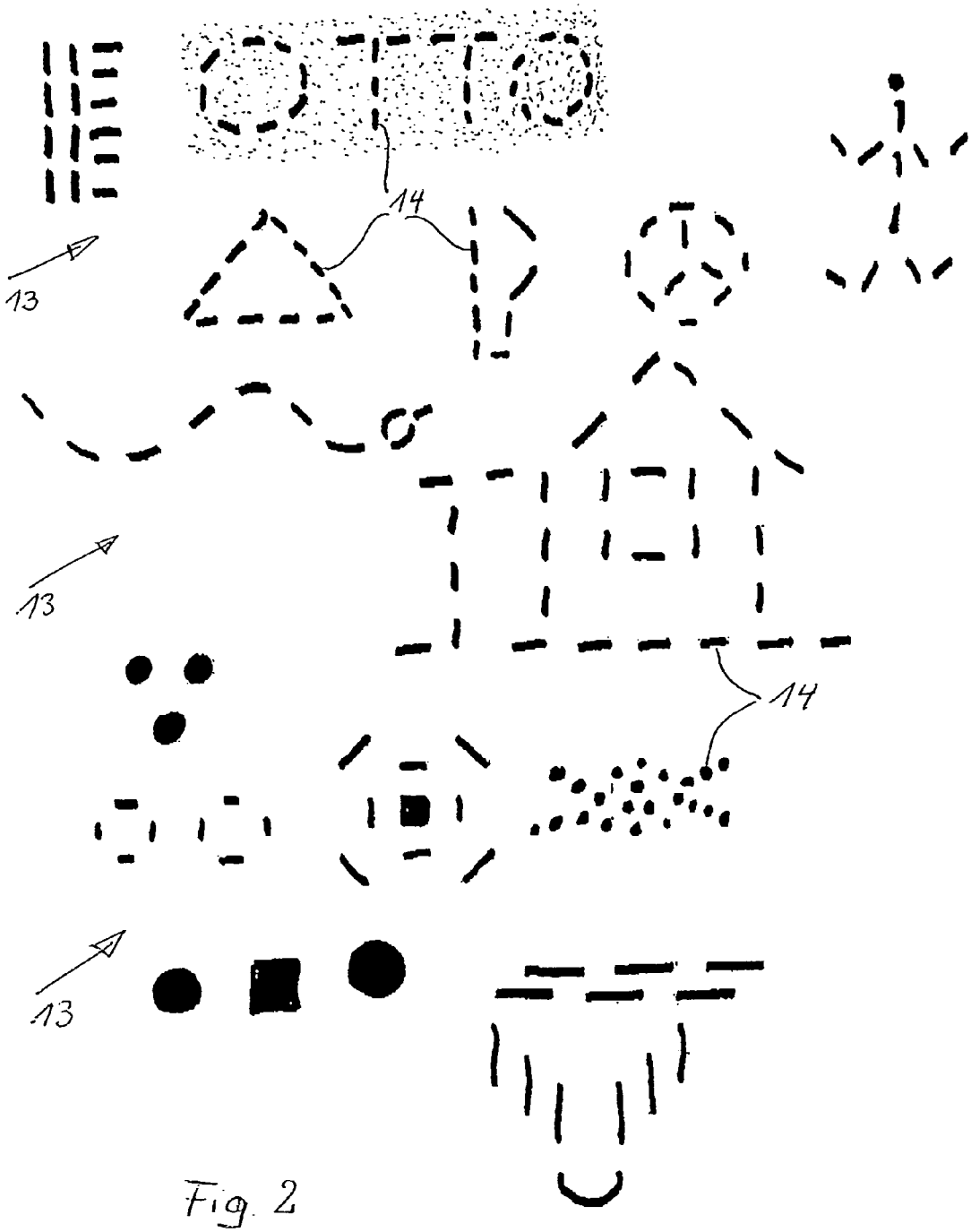

An apparatus for performing the method is depicted in exemplary fashion in the drawings, in which:

FIG. 1 is a longitudinal section through a conventional perforated-drum apparatus and FIG. 2 is a plan view of the peripheral surface of a drum having various patterns as images made up of slots.

A normal perforated-drum apparatus is made up of a roughly rectangular housing 1, which is divided by a partition 2 into a treatment compartment 3 and a fan compartment 4. The perforated drum is rotatably mounted in treatment compartment 3, and in fan compartment 4 a fan 6 is rotatably mounted concentrically to the perforated drum. Of course, the fan compartment can also be arranged in a separate fan housing, not depicted here, separate from perforated drum housing 1. In either case the fan sets up a suction in the interior of the drum.

According to FIG. 1, heating units 7 made up of tubes through which heating medium flows are arranged both above and below fan 6. In the region not covered by the nonwoven fabric, the drum is covered against the suction by an inner cover 8. The effective surface of the drum is formed by a perforated sheet 5. This can be surrounded externally by a foil or steel belt 9 spaced away from the surface, which foil or steel belt is held clamped on the end of the drum at the two bases 11, 12. The pattern-imparting openings can be made directly in the drum or also in the foil if a foil is used. In the latter case there is no longer an ordinary perforated drum but rather a smooth drum with a pattern-imparting peripheral surface. In order to impart a neat, clearly figured pattern, the drum, foil, or the like should be as a whole permeable to air, for example microperforated, so that the fluid sucked in can be led away in full-surface fashion and not merely on the pattern surfaces.

A perforated drum of this type as cited above serves in general for drying. Simultaneously or also alone, it can be serviceable for colorless patterning in that the smooth peripheral surface supporting the fabric web has perforations that cause a three-dimensional pattern 13 to arise on the nonwoven fabric. These perforations can be slots 14, crosses, oval or round holes, or other openings that, together with others, produce a desired pictorial pattern 13. Images of the type envisioned are shown in FIG. 2. In the "OTTO" pictorial pattern in this figure, the foil or the like is made permeable not merely for the pattern "OTTO" but conveying element 9 is permeable, for example microperforated, over its full area.

In a continuous installation, the apparatus for patterning can be employed following a wet treatment for simultaneous drying or also merely for patterning alone. The medium, such as air, fluid, or steam, must be selected as appropriate.

The invention claimed is:

1. Method for colorless patterning of a fabric web made of mutually interlocked and thus strengthened fibers of natural or synthetic type, comprising;

supporting the fabric web on a conveying element having a smooth support surface on which the fabric web is supported, the smooth support surface being permeable to a fluid over an entire area on which the fabric web is supported and having perforations arranged in a pictorial pattern, pressing the fabric web by an overpressure and underpressure acting on a fluid against the conveying element, cross-sectional areas of the perforations generating a pictorial pattern on the fabric web, and leading the fluid away from the fabric web in a region of the perforations of the conveying element and also in a region of the smooth support surface supporting the fabric web.

2. Method according to claim 1, characterized in that water is used as the fluid.

3. Method according to claim 1, characterized in that the fluid comprises air or gas.

4. Method according to claim 1, characterized in that the fluid is heated.

5. Method according to claim 1, characterized in that steam is used as the fluid.

6. Method according to any one of claims 3 to 5, characterized in that the pictorial pattern is generated during drying of the fabric web.

7. Method according to any one of claims 3 to 5, characterized in that the pictorial pattern is generated after drying of the fabric web.

8. Method according to claim 7, characterized in that the pictorial pattern is generated by steam on a dry nonwoven fabric.

9. Method according to claim 1, wherein the conveying element is an external peripheral surface of a drum.

10. Method according to claim 1, wherein the smooth support surface is provided with microperforations so as to be permeable to a fluid and each of the perforations has a larger cross-sectional area that each of the microperforations.

11. Method according to claim 1, further comprising hydrodynamically needling the fabric web prior to pressing the fabric web against the conveying element.

12. Method according to claim 1, wherein the perforations are irregularly arranged.

13. Method according to claim 1, wherein perforations are patterned in the shape of at least one letter.

14. Apparatus for the colorless patterning of a fabric web made of mutually interlocked and thus strengthened fibers of natural or synthetic type, comprising:

a housing; and a revolving drum provided in the housing, wherein an external peripheral surface of the drum is provided with perforations depicting an image, which perforations act in diverse pattern-imparting fashions on a fabric web resting thereon in use, the drum as a whole is microperforated and thus fluid-permeable over an entire surface for supporting the fabric web, and the perforations depicting the image are sized larger than the microperforation of the surface supporting the fabric web, whereby the fabric web can be pressed by an overpressure and underpressure acting on a fluid against the drum having the perforations so that cross-sectional areas of the perforations generate a pictorial pattern on the fabric web.

15. Apparatus according to claim 14, characterized in that the drum is provided with the perforations and microperforation.

16. Apparatus according to claim 14, characterized in that a conveying element having the perforations and microperforations is slid over the drum and this conveying element is fashioned as a continuously advancing foil or belt.

17. Apparatus according to claim 16, characterized in that a foil or a steel belt having the perforations and microperforations is slid onto the drum and spaced away therefrom.

18. Apparatus according to any one of claims 15 to 17, characterized in that the cross-sectional area of the perforations is made up of straight or curved slits or holes oriented over the surface of the conveying element and depicting an image.

19. Apparatus according to claim 18, characterized in that the slits or holes are arranged to form names, images, or patterns.

20. Apparatus according to claim 19, characterized in that the slits holes are stamped or laser-cut in the peripheral surface of the drum.

21. Apparatus according to claim 18, characterized in that the slits or holes are stamped or laser-cut in the peripheral surface of the drum.

22. Apparatus according to claim 14, further comprising means for generating an overpressure acting on a fluid outside the drum and an underpressure acting on a fluid from within the drum.

23. Apparatus according to claim 14, wherein the external peripheral surface of the drum is smooth but for the perforations and microperforation.

24. Apparatus according to claim 14, wherein the perforations are irregularly arranged.

25. Apparatus according to claim 14, wherein the perforations are patterned in the shape of at least one letter.

* * * * *